US006213596B1

(12) United States Patent
Nowell, Jr. et al.

(10) Patent No.: US 6,213,596 B1
(45) Date of Patent: Apr. 10, 2001

(54) METHOD AND APPARATUS FOR REDUCING ENTRAINED AIR IN INK FOR INK JET CARTRIDGES USED IN INK JET PRINTERS

(75) Inventors: Ronald Monroe Nowell, Jr., Lexington; Julie Ann Gordon Whitney, Georgetown, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/451,334

(22) Filed: Nov. 30, 1999

(51) Int. Cl.[7] ..... B41J 2/175
(52) U.S. Cl. ..... 347/85; 347/92
(58) Field of Search ..... 347/84, 85, 86, 347/87, 92, 95, 97

(56) References Cited

U.S. PATENT DOCUMENTS

| | | | |
|---|---|---|---|
| 4,007,684 | 2/1977 | Takano et al. | 101/366 |
| 4,301,459 | 11/1981 | Isayama et al. | 347/19 |
| 4,340,895 | 7/1982 | Kikuchi | 347/92 |
| 4,558,326 | 12/1985 | Kimura et al. | 347/30 |
| 4,668,965 | 5/1987 | Tanaka et al. | 347/26 |
| 5,341,162 * | 8/1994 | Hermanson et al. | 347/92 |
| 6,007,193 * | 12/1999 | Kashimura et al. | 347/92 |

* cited by examiner

*Primary Examiner*—N. Le
*Assistant Examiner*—Anh T. N. Vo
(74) *Attorney, Agent, or Firm*—Michael T. Sanderson

(57) ABSTRACT

A method and apparatus for reducing the amount of air entrained in ink of ink jet printer cartridges especially during filling of the ink cartridge is disclosed. The method includes providing ink suitable for ink jet printing heating the ink to a predetermined temperature range to liberate air entrained in the ink, and then filling the ink jet cartridge while maintaining the elevated temperature of the ink. The apparatus includes an ink holding tank in fluid communication via a conduit with an air removal device that includes a heater adapted to elevate the temperature of the ink and liberate air entrained therein. The air removal device is in turn in fluid communication via a second conduit with an ink cartridge. Preferably, the heater is a temperature controlled resistance heater while the air removal device further includes a baffled holding chamber adapted to allow the ink time to reach and maintain the elevated temperature. The second conduit may include a second resistance heater to help maintain the elevated temperature of the ink during transfer of the heated ink from the heater to the ink cartridge during filling.

20 Claims, 1 Drawing Sheet

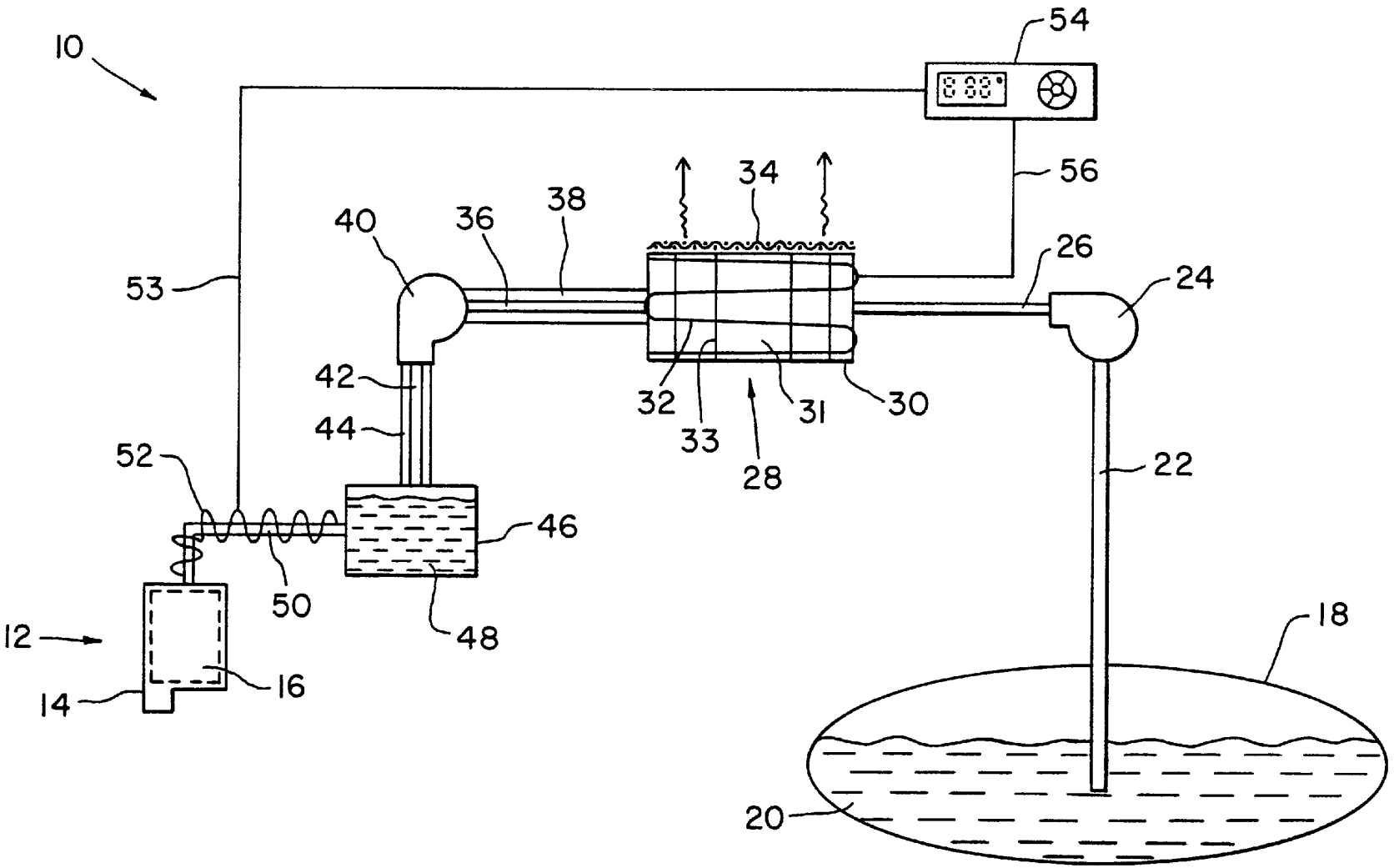
10
12
14
16
18
20
22
24
26
28
30
31
32
33
34
36
38
40
42
44
46
48
50
52
53
54
56

METHOD AND APPARATUS FOR REDUCING ENTRAINED AIR IN INK FOR INK JET CARTRIDGES USED IN INK JET PRINTERS

BACKGROUND OF THE INVENTION

1. Field of the invention.

The present invention relates to ink jet cartridges used in ink jet printers and, more particularly, to the filling of ink jet cartridges with ink.

2. Description of the related art.

Ink jet printers utilize cartridges that hold ink and which selectively dispense or eject the ink during printing. The cartridges are filled with ink after manufacture. Once the cartridge is filled with ink, the cartridge is sealed and ready for use.

Ink jet cartridges typically include a body or housing defining a chamber or cavity for the ink, a printhead in fluid communication with the ink chamber including a plurality of ink emitting nozzles, and circuitry coupled to the printhead and adapted to allow controlled ejection of ink from selected nozzles during printing. The printhead/circuitry includes heating elements associated with each nozzle that allow the ink to be ejected from the nozzle by forming drops. Thus, the ink is naturally heated in a very small, localized manner during the printing process. Ink jet printing is essentially a thermal ink ejecting system.

However, historical data shows that ink jet printing with a temperature offset or at a rate of drop ejection that causes a temperature offset may cause individual nozzles to not fire. It has been found that the resulting elevation in printing temperature releases air entrained within the ink which inhibits the formation of the ink drop and thus the ejection of the ink drop from the nozzle. This is due to the fact that the ink was supersaturated with air during the process of filling the ink cartridge.

The amount of air that dissolves in ink is a function of the temperature of the ink. The function is an inverse ratio with cooler ink holding or entraining more air than warmer ink. Thus as the printhead heats up during use, air or gas is liberated from the ink in the form of small air bubbles. These air bubbles may clog the nozzles of the printhead.

Conventional filling processes for ink cartridges are accomplished with room temperature ink. As a result, the ink becomes supersaturated with air. This further results in visible air bubbles at the nozzles of the printhead even at the point of manufacture let alone during printing. Degassing the ink prior to filling the ink cartridge will not appreciably solve the problem as air quickly re-dissolves into the ink during the fill process.

What is needed is a method to reduce the supersaturation of the ink with air during the ink cartridge fill process.

What is also needed is a method of reducing the amount of entrained air in ink for ink jet cartridges.

What is further needed is an apparatus for reducing the amount of entrained air in ink for ink jet cartridges during the cartridge filling process.

SUMMARY OF THE INVENTION

The present invention is directed to a method and apparatus for reducing the amount of air entrained in ink within ink jet printer cartridges.

In one form the present invention is a method for filling an ink jet cartridge with ink. The method includes providing ink suitable for ink jet printing, heating the ink to a temperature above ambient temperature to liberate air entrained in the ink and then filling the ink jet cartridge with the ink while substantially maintaining the elevated temperature of the ink.

The method preferably includes heating the ink with a temperature controlled resistance heater within a holding chamber baffled to allow the ink time to reach and maintain an appropriate temperature that is above ambient temperature. Resistance heated fill tubes in fluid communication with the holding chamber and the ink cartridge maintain the elevated temperature of the ink during filling of the ink cartridge. When the ink, now within the ink cartridge, reaches ambient temperature, it will be at or below an air saturation level of the ink for ambient conditions.

A target temperature for the ink is a temperature that is high enough such that the resulting supersaturation level for air in the ink is equivalent to the saturation level for air in ambient or room temperature ink. Once the ink cartridge is filled with the heated ink the ink cartridge is sealed. The ink is thereafter allowed to reach ambient temperature without further heating.

The method may also include utilizing an ultrasonic generator during heating to assist in the removal of air entrained in the ink. Prior to filling the ink cartridge and after heating the ink, the air evolved ink may also be stored in an accumulator/regulator tank. Such storage must be temporary as evaporation caused by the elevated temperature can change ink composition. Ink must then be re-heated prior to fill, or kept at reduced air pressure.

In another form, the present invention is an apparatus for filling an ink jet cartridge with ink. An ink holding tank is in fluid communication via a conduit with an air removal device adapted to elevate the temperature of the ink and liberate air entrained therein. The air removal device is in turn in fluid communication via a second conduit with an ink cartridge which is filled with the heated ink.

Preferably, the air removal device includes a temperature controlled resistance heater and a baffled ink holding chamber adapted to allow the ink time to reach and maintain a predetermined temperature. The second conduit may include a second resistance heater to help maintain the elevated temperature of the ink during transfer of the heated ink from the air removal device to the ink cartridge during filling.

An advantage of the present invention is that the ink within the ink cartridge will not form as many bubbles due to entrained air during printing.

Another advantage of the present invention is that agitation of the ink during the fill process does not result in excess entrained air.

Yet another advantage of the present invention is that clogs in ink jet cartridge printhead nozzles due to entrained air during printing are reduced.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing wherein there is shown a diagrammatic view of an ink jet cartridge being filled with ink in accordance with the principles of the present invention.

The exemplification set out herein illustrates a preferred embodiment of the invention in one form, and such exemplification is not to be construed as limiting the scope of the invention in any manner.

DETAILED DESCRIPTION OF THE INVENTION

Referring now to the drawing there is shown apparatus 10 for thermally elevating or heating ink above ambient temperature for ink jet printer cartridge 12 which is used in an ink jet printer (not shown). Ink jet printer cartridge 12 includes body 14 housing ink reservoir 16. Ink reservoir 16 is in fluid communication with a printhead (not shown) as is known in the art for ejecting ink onto a print medium such as paper when installed into the ink jet printer. The printhead is controlled in a known manner when installed into the ink jet printer.

Apparatus 10 includes tank or reservoir 18 that holds ink 20 which is suitable for use in ink jet printing. Ink 20 is held at ambient temperature within tank 18. Tank 18 is in fluid communication with conduit or tube 22 that is in fluid communication with pump 24. Pump 24 is in fluid communication with conduit or tube 26 that is in fluid communication with air removal device 28. Pump 24 is preferably controllable in a manner so as to allow flow rate control of ink 20. Conduit 26 is in fluid communication with air removal device 28 such that ink 20 from tank 18 may be pumped therein.

Air removal device 28 includes tank 30 defining holding area 31 into which ink 20 is driven by pump 24. Holding area 31 has baffles 33 therein and at least one heater coil 32 that is preferably a resistance type heating coil. Heater coil 32 is preferably coupled to controller/regulator 54 via communication line 56 for controlling and/or regulating the temperature of heater coil 32 and thus the ink held or circulating therein. Baffles 33 provide a circuitous route for the ink to allow the ink time to reach an elevated temperature to drive off or liberate air entrained within the ink as signified by the wavy arrows emanating from screen 34. Air removal device 28 may include an ultrasonic generator (not shown) to aid in air removal.

Tank 30 is in fluid communication with pump 40 via conduit 36 that includes insulation 38. Pump 40, via conduit 42, is in fluid communication with temporary holding or accumulation/regulation tank 46 where temperature elevated ink 48 is held. The heated, and thus air evolved ink may be temporarily stored in tank 46. The ink is maintained at substantially the same elevated temperature as when it exited air removal device 28. Conduit 42 includes insulation 44 in like manner as conduit 36. Pump 40 like pump 24, is preferably controllable to regulate the amount of ink flow therethrough and thus into tank 46. Insulation 38 of conduit 36 and insulation 44 of conduit 42 helps maintain the elevated temperature of the ink after exiting air removal device 28. Likewise, tank 46 may be heated or tank 46 may be thermally insulated to retain the heat in the ink.

Tank 46 is in fluid communication with reservoir 16 of ink cartridge 12 via conduit 50 in a known manner. Conduit 50 preferably includes heater coil 52 that is coupled to controller/regulator 54 via communication line 53 to aid in maintaining the elevated temperature of the ink while being carried within conduit 50 during the cartridge filling process.

Ink cartridge 12 is thus filled with air evolved ink in the following manner. Tank 18 holds a reserve of ink 20 that is at ambient temperature and thus can be supersaturated with air when pumped or moved. Pump 24 draws ink 20 from tank 18 via conduit 22 and sends ink 20 into air removal device 28 via conduit 26. Once the ink is within tank 30, heater coil 32 elevates the temperature of the ink preferably under control of regulator/controller 54. A target temperature for the ink is one that is high enough such that the supersaturation level of air in the ink is equivalent to the saturation level of air in ink at ambient or room temperature. Baffles 33 impede the flow of ink therethrough to allow enough time for the ink to reach the elevated temperature and liberate the air entrained therein.

Pump 40 draws the temperature elevated ink from air removal device 28 through conduit 36 and into tank 46 via conduit 42. Temperature elevated ink 48 within tank 46 is transferred into ink reservoir 16 of ink cartridge 12 through conduit 50 which maintains the elevated temperature of the ink by heater coil 52. By maintaining the ink at the elevated temperature, the air driven off by air removal device 28 does not re-dissolve or saturate into the ink during the filling process. Once the ink has been received into ink reservoir 16, cartridge 12 is removed from the filling position, and allowed to cool at room temperature.

During the fill process and cooling, some air will become saturated into the ink. However, the present method and apparatus limits the amount of air entrained in the ink by driving off the entrained air, reducing the amount of re-entrained air by maintaining the temperature of the ink during the filling process of the ink cartridge. assist removal of air from the ink, ultrasonic energy may be applied to the ink. The ultrasound waves speed air removal from the ink and the elevated temperature maintains that saturation level. The use of ultrasonic energy to speed air removal from ink is known, and thus is not described in further detail herein.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for filling an ink jet printer cartridge with ink, the ink jet printer cartridge having a body defining an ink reservoir to be filled, the method comprising the steps of:

providing ink having a temperature approximately equal to an ambient temperature;

elevating the temperature of the ink above the ambient temperature, wherein entrained air is released from the ink; and filling the ink reservoir of the ink jet printer cartridge with the elevated temperature ink while substantially maintaining the elevated temperature of the ink.

2. The method of claim 1, wherein the step of elevating the temperature of the ink includes circulating the ink through a baffled chamber having a resistance heater.

3. The method of claim 2, further comprising the step of allowing the temperature elevated ink to return to the ambient temperature while in the ink reservoir after the step of filling the ink reservoir.

4. The method of claim 1, wherein the elevated temperature of the ink is substantially maintained by a heated fill conduit.

5. The method of claim 1, wherein the ink is elevated to a temperature such that a resulting supersaturation level of air of the temperature elevated ink is equivalent to or below a saturation level of air of ambient temperature ink.

6. The method of claim 1, comprising the further step of sealing the ink jet printer cartridge after said filling step.

7. A method for reducing an amount of entrained air in ink for an ink jet cartridge, the method comprising the steps of:

providing ink having a temperature approximately equal to an ambient temperature;

heating the ink to a temperature whereat a supersaturation level of air for the ink is equivalent to or below a saturation level of air for the ink at ambient temperature; and filling the ink jet cartridge with the heated ink while substantially maintaining the temperature whereat the supersaturation level of air for the ink is equivalent to or below the saturation level of air for the ink at ambient temperature.

8. The method of claim 7, wherein the step of heating the ink includes circulating the ink through a baffled chamber having a resistance heater.

9. The method of claim 7, further comprising the step of allowing the heated ink to return to the ambient temperature while in the ink cartridge after filling the ink cartridge.

10. An ink jet printer apparatus comprising:

an ink jet printer cartridge including a body having an ink reservoir;

a first ink holding tank;

an air removal device in fluid communication with said ink holding tank, said air removal device adapted to receive the ink from said ink holding tank and to elevate a temperature of the received ink to liberate air entrained therein; and a fill conduit in fluid communication with said air removal device and the ink cartridge, said fill conduit adapted to substantially maintain the elevated temperature of the ink from said air removal device during filling of the ink jet printer cartridge.

11. The apparatus for filling an ink jet printer cartridge with ink of claim 10, wherein said air removal device comprises:

a baffled tank; and a first resistance heater.

12. The apparatus of claim 11, wherein said resistance heater is adapted to elevate the temperature of the received ink wherein a supersaturation level of air for the ink is equivalent to or below a saturation level of air for the ink at ambient temperature.

13. The apparatus of claim 11, wherein said fill conduit includes a second resistance heater.

14. The apparatus of claim 10, further comprising a second ink holding tank disposed in said conduit.

15. The apparatus of claim 14, wherein said second ink holding tank is heated.

16. The apparatus of claim 14, wherein said second ink holding tank is thermally insulated.

17. An apparatus for reducing an amount of entrained air in ink for an ink jet cartridge, the apparatus comprising:

an ink holding tank;

a heater adapted to elevate a temperature of ink from said ink holding tank to an ambient air saturation equivalent temperature whereat a supersaturation level of air for the ink is equivalent to or below a saturation level of air for the ink at ambient temperature; and a conduit in fluid communication with said heater and the ink jet cartridge for filling the ink jet cartridge with the ink from said heater, said conduit adapted to substantially maintain the ink from said heater at the ambient air saturation equivalent temperature during filling of the ink jet cartridge.

18. The apparatus of claim 17, further comprising:

a first pump disposed between said ink holding tank and said heater. and a second pump disposed in said conduit.

19. The apparatus of claim 17, wherein said heater comprises:

a baffled tank; and a first resistance heater.

20. The apparatus of claim 19, wherein said conduit includes a second resistance heater.

* * * * *